US007822362B2

(12) United States Patent
Watanabe et al.

(10) Patent No.: US 7,822,362 B2
(45) Date of Patent: Oct. 26, 2010

(54) IMAGE FORMING APPARATUS

(75) Inventors: Yasunori Watanabe, Nagoya (JP); Takuya Yamaguchi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 9 days.

(21) Appl. No.: 12/406,981

(22) Filed: Mar. 19, 2009

(65) Prior Publication Data

US 2009/0252527 A1 Oct. 8, 2009

(30) Foreign Application Priority Data

Apr. 4, 2008 (JP) ..... 2008-098288

(51) Int. Cl.
*G03G 15/00* (2006.01)

(52) U.S. Cl. ..... 399/125; 399/107

(58) Field of Classification Search ..... 399/107, 399/110, 125

See application file for complete search history.

(56) References Cited

U.S. PATENT DOCUMENTS 6,462,839 B1 10/2002 Short
6,741,820 B2 5/2004 Nobe et al.
7,019,870 B2 3/2006 Kameyama et al.
7,570,898 B2 * 8/2009 Onose et al. ..... 399/90
7,680,431 B2 * 3/2010 Ikebata ..... 399/107

FOREIGN PATENT DOCUMENTS

JP 2001-281771 10/2001
JP 2002-247264 8/2002

* cited by examiner

*Primary Examiner*—Hoang Ngo
(74) *Attorney, Agent, or Firm*—Banner & Witcoff, Ltd.

(57) ABSTRACT

An image forming apparatus includes: an apparatus body; a first rotating body having a first end supported on the apparatus body rotatably about an axis so that the first rotating body is rotatable between an adjacent state and a distant state in which a second end is more distant from the apparatus body than the adjacent state; an arm having a first end rotatably supported on the apparatus body, and a second end connected to the first rotating body to be slidable in a direction perpendicular to the axis; and an urging member having a first end connected to the arm, and a second end connected to the first rotating body at a position between the axis and a connecting portion to which the arm is connected, the urging member urges the arm in a direction of drawing the second end of the arm toward the axis.

11 Claims, 12 Drawing Sheets

IMAGE FORMING APPARATUS

CROSS-REFERENCE TO RELATED APPLICATION

This application claims priority from Japanese Patent Application No. 2008-098288, filed on Apr. 4, 2008, the entire subject matter of which is incorporated herein by reference.

TECHNICAL FIELD

Aspects of the present invention relate to an image forming apparatus, such as an electrophotographic printer.

BACKGROUND

JP-A-2001-281771 describes an image forming apparatus such as a printer includes an image forming unit as an apparatus body and a read unit for reading an image formed on a document is disposed above the imaging forming unit. The read unit and the imaging forming unit are connected with each other by a hinge, and the read unit is provided to be openable and closable at posture closing an upper surface of the image forming unit and posture opening the upper surface of the image forming unit. In a state where the read unit is opened to make the upper surface of the image forming unit open, the maintenance, such as an operation of removing a jam within the image forming unit and an operation of exchanging a part disposed in the image forming unit, can be performed.

However, the read unit may collide with a wall disposed at the hinge side of the image forming apparatus when the read unit is largely opened. In addition, since the read unit is relatively heavy, the image forming apparatus may be unbalanced to fall when the read unit is largely opened.

For this reason, it is advantageous to regulate a maximum openable angle of the read unit with respect to the image forming unit to 90° or less. For example, the maximum openable angle of the read unit with respect to the image forming unit may be regulated by connecting the read unit with the image forming unit using a wire. However, with this configuration, the operator has to support the read unit by hand during the maintenance, and therefore, the workability is worse.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the preset invention to provide an image forming apparatus capable of holding a first rotating body which is rotatable between an adjacent state relatively adjacent to an apparatus body and a distant state relatively distant from the apparatus body, in the distant state.

According to an exemplary embodiment of the present invention, there is provided an image forming apparatus comprising: an apparatus body; a first rotating body comprising a first end, and a second end opposite to the first end, the first end being supported on the apparatus body rotatably about an axis so that the first rotating body is rotatable between an adjacent state in which the second end is close to the apparatus body, and a distant state in which the second end is more distant from the apparatus body than the adjacent state; an arm comprising a first end rotatably supported on the apparatus body, and a second end opposite to the first end, the second end being connected to the first rotating body to be slidable in a direction perpendicular to the axis; and an urging member comprising a first end connected to the arm, and a second end opposite to the first end, the second end being connected to the first rotating body at a position between the axis and a connecting portion to which the arm is connected, the urging member applying an urging force to the arm in a direction of drawing the second end of the arm toward the axis.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, an exemplary embodiment of the present invention will be described in detail with reference to the accompanying drawings.

1. Overall Configuration of a Printer

Figure 1:
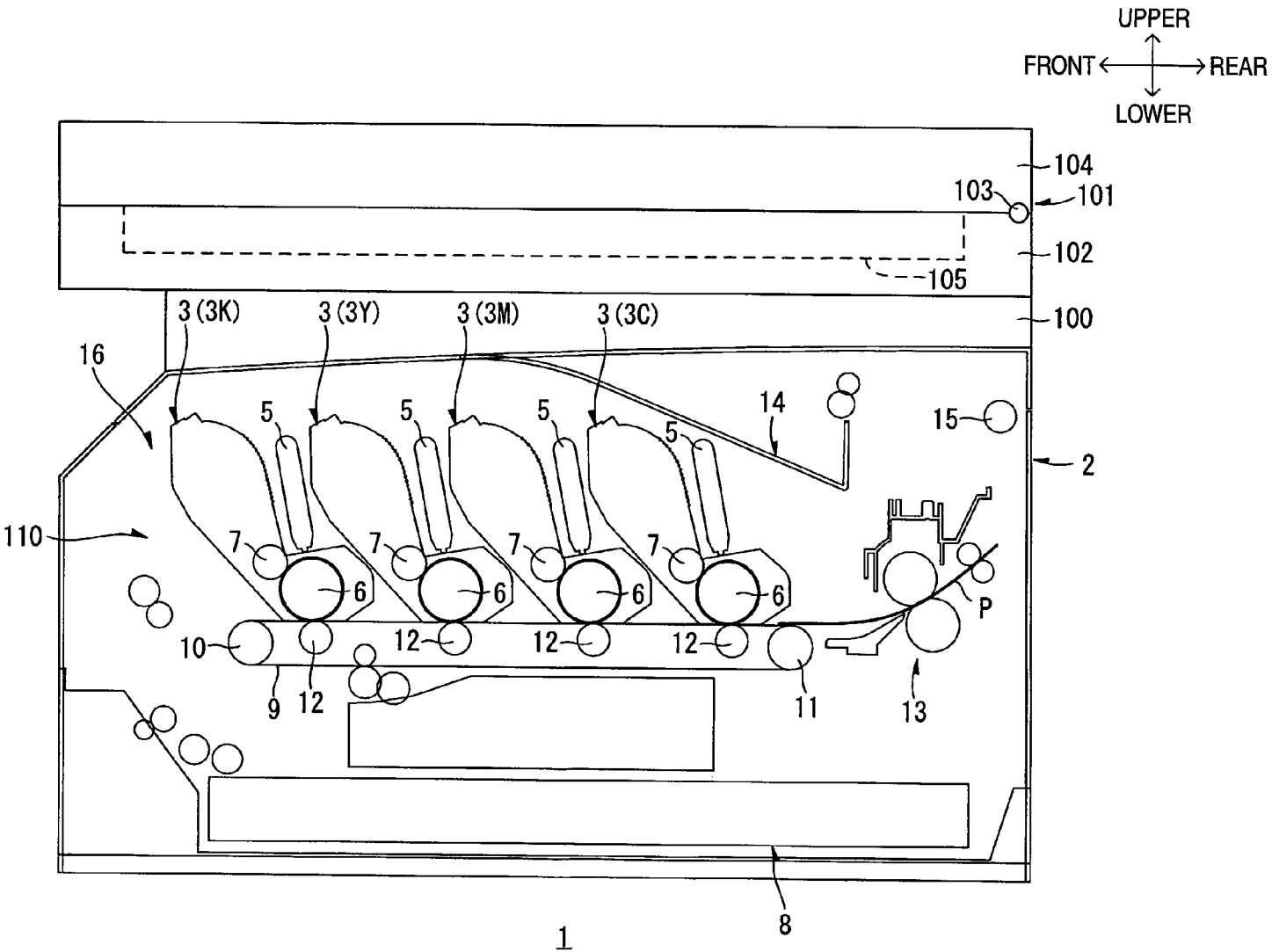
FIG. 1 is a side sectional view showing a printer according to an exemplary embodiment of the present invention.
Figure 2:
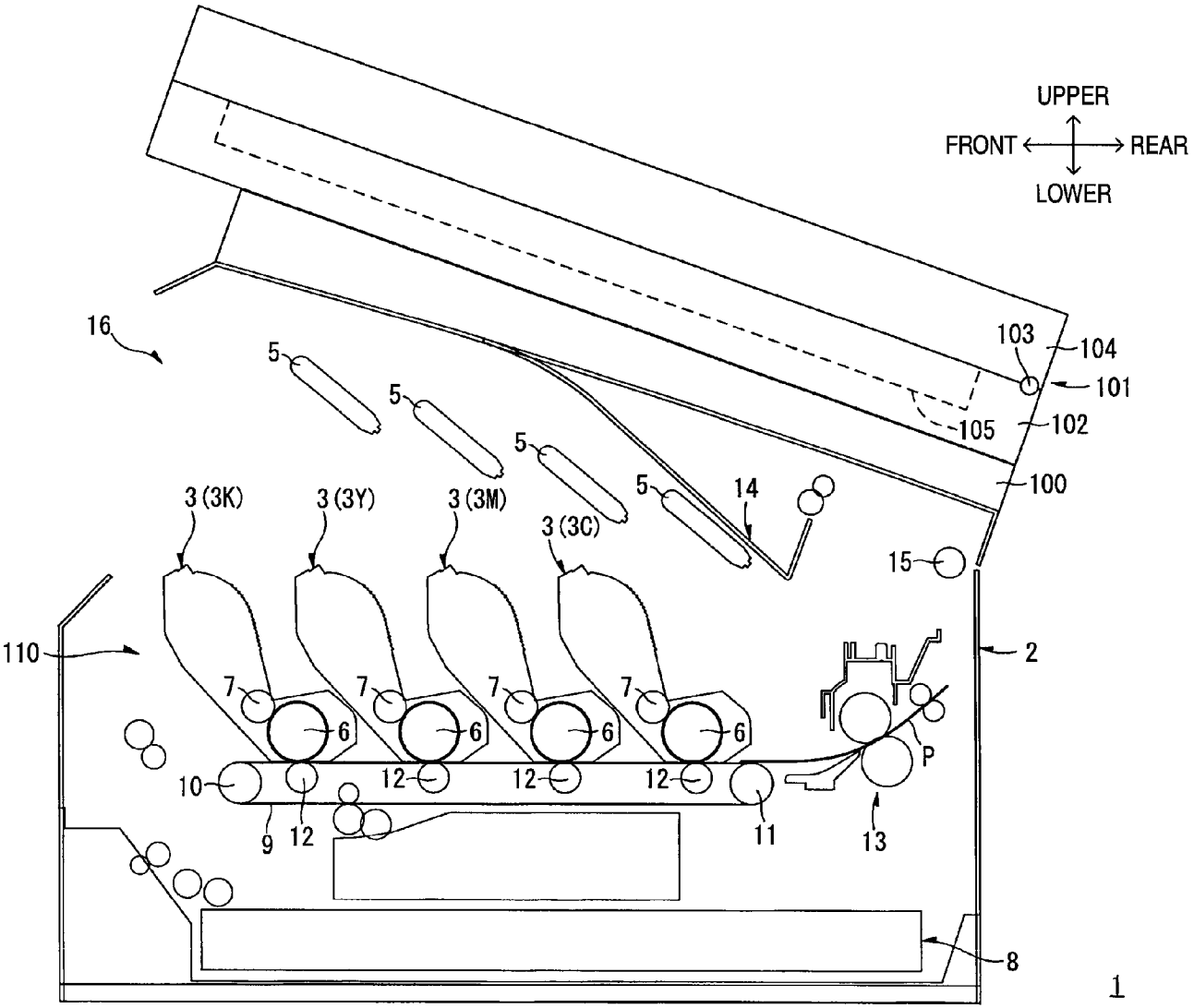
FIG. 2 is a side sectional view showing a state where a support member is opened in the printer shown in FIG. 1.

FIG. 1 is a side sectional view showing a printer according to an exemplary embodiment of the present invention. FIG. 2 is a side sectional view showing a state where a support member is opened in the printer shown in FIG. 1.

A printer 1 is a so-called multifunction machine including an apparatus body 2 formed in a box shape and a flatbed scanner 101 supported on the apparatus body 2 by a support member 100.

(1) Apparatus Body

As shown in FIG. 1, the apparatus body 2 is formed in the shape of a box having an opening 16 on an upper surface. The support member 100 has first end, which is supported to be rotatable about a rotating shaft 15 provided at an upper end of the apparatus body 2, and is rotatable between an adjacent state in which the second end opposite to the first end becomes relatively adjacent to the apparatus body 2, and a distant state in which the second end becomes relatively distant from the apparatus body 2. That is, the second end in the distant state is more distant from the apparatus body 2 than that in the adjacent state.

When the support member 100 is in the adjacent state, an upstream side in a conveyance direction of sheet P using a conveyance belt 9, which will be described later, is taken as a front side of the printer 1. Left and right sides in the printer 1 are determined when the printer 1 is viewed from the front side. In each drawing, arrows indicating front and rear, upper and lower, and left and right directions are shown.

An image forming portion 110 is provided in the apparatus body 2. Four drum units 3 are disposed in parallel in the image forming portion 110. The drum units 3 are provided corresponding to colors of black, yellow, magenta, and cyan and are arrayed in order of black, yellow, magenta, and cyan in the conveyance direction of the sheet P using the conveyance belt 9 to be described later. As shown in FIG. 2, each drum unit 3 is removably mounted in the apparatus body 2 through the opening 16 of the apparatus body 2 when the support member 100 is in the distant state.

It is noted that, for the drum units 3, K (black), Y (yellow), M (magenta), and C (cyan) indicating respective colors are added to ends of reference numerals in FIGS. 1 and 2.

Each drum unit 3 includes a photosensitive drum 6 and a developing roller 7. A surface of the photosensitive drum 6 is uniformly charged by a scorotron-type charger (not shown) as the photosensitive drum 6 rotates.

On the other hand, an LED unit 5 is rotatably supported on the support member 100. Four LED units 5 are disposed in parallel corresponding to the drum units 3. Each LED unit 5 takes a first posture in which the tip of the LED unit 5 faces a circumferential surface of the photosensitive drum 6 when the support member 100 is in the adjacent state. The LED units 5 are retracted from the inside of the apparatus body 2 when the support member 100 is in the distant state. In this case, the tip of the LED unit 5 takes a second posture facing toward the rotating shaft 15 of the apparatus body 2 as shown in FIG. 2.

The photosensitive drum 6 uniformly charged by the scorotron-type charger is selectively exposed by the LED unit 5. By the exposure, electric charges are selectively removed from the surface of the photosensitive drum 6. As a result, an electrostatic latent image is formed on the surface of the photosensitive drum 6. A developing bias is applied to the developing roller 7. When the electrostatic latent image faces the developing roller 7, toner is supplied from the developing roller 7 to the electrostatic latent image due to the potential difference between the electrostatic latent image and the developing roller 7. As a result, a toner image is formed on the surface of the photosensitive drum 6.

A sheet feed cassette 8 in which the sheet P is set is disposed on a bottom portion of the apparatus body 2. The sheet P set in the sheet feed cassette 8 is conveyed on the conveyance belt 9 by various rollers. The conveyance belt 9 is wound around a pair of driving roller 11 and driven roller 10 and is disposed to face the four photosensitive drums 6 from the lower side. A transfer roller 12 is disposed at a position facing each photosensitive drum 6 with an upper part of the conveyance belt 9 interposed therebetween. The sheet P conveyed on the conveyance belt 9 passes between the conveyance belt 9 and the photosensitive drums 6 sequentially as the conveyance belt 9 travels. Then, a toner image on the surface of the photosensitive drum 6 is transferred onto the sheet P by a transfer bias applied to the transfer roller 12 when the toner image faces the sheet P.

A fixing unit 13 is provided at a downstream side of the conveyance belt 9 in the conveyance direction of the sheet P. The sheet P on which the toner image has been transferred is conveyed to the fixing unit 13. In the fixing unit 13, the toner image is fixed on the sheet P by heat and pressure. The sheet P on which the toner image has been fixed is discharged to a sheet discharge tray 14 of the support member 100 by various rollers.

(2) Flatbed Scanner

The flatbed scanner 101 is supported on the support member 100. The flatbed scanner 101 is provided above the sheet discharge tray 14.

As shown in FIGS. 1 and 2, the flatbed scanner 101 includes a document platen 102 fixed to the support member 100 and a pressing cover 104 rotatably supported on the document platen 102.

The document platen 102 is formed in a rectangular plate shape in plan view. A glass surface 105 on which a document is placed and which is indicated by a dotted line in FIGS. 1 and 2 is provided on an upper surface of the document platen 102. A CCD sensor (not shown) for reading a document in a state where the document is placed on the glass surface 105 is provided inside the document platen 102.

The pressing cover 104 is formed in a rectangular plate shape in plan view. A rear end of the pressing cover 104 and a rear end of the document platen 102 are connected to each other by a hinge 103. The pressing cover 104 is rotatable between a closed position at which the glass surface 105 is covered from the upper side, and an open position at which the glass surface 105 is exposed from the upper side.

Hereinafter, an explanation will be made while assuming that the pressing cover 104 is at the closed position if not particularly mentioned.

2. Opening and Closing Mechanism of a Support Member

Figure 3:
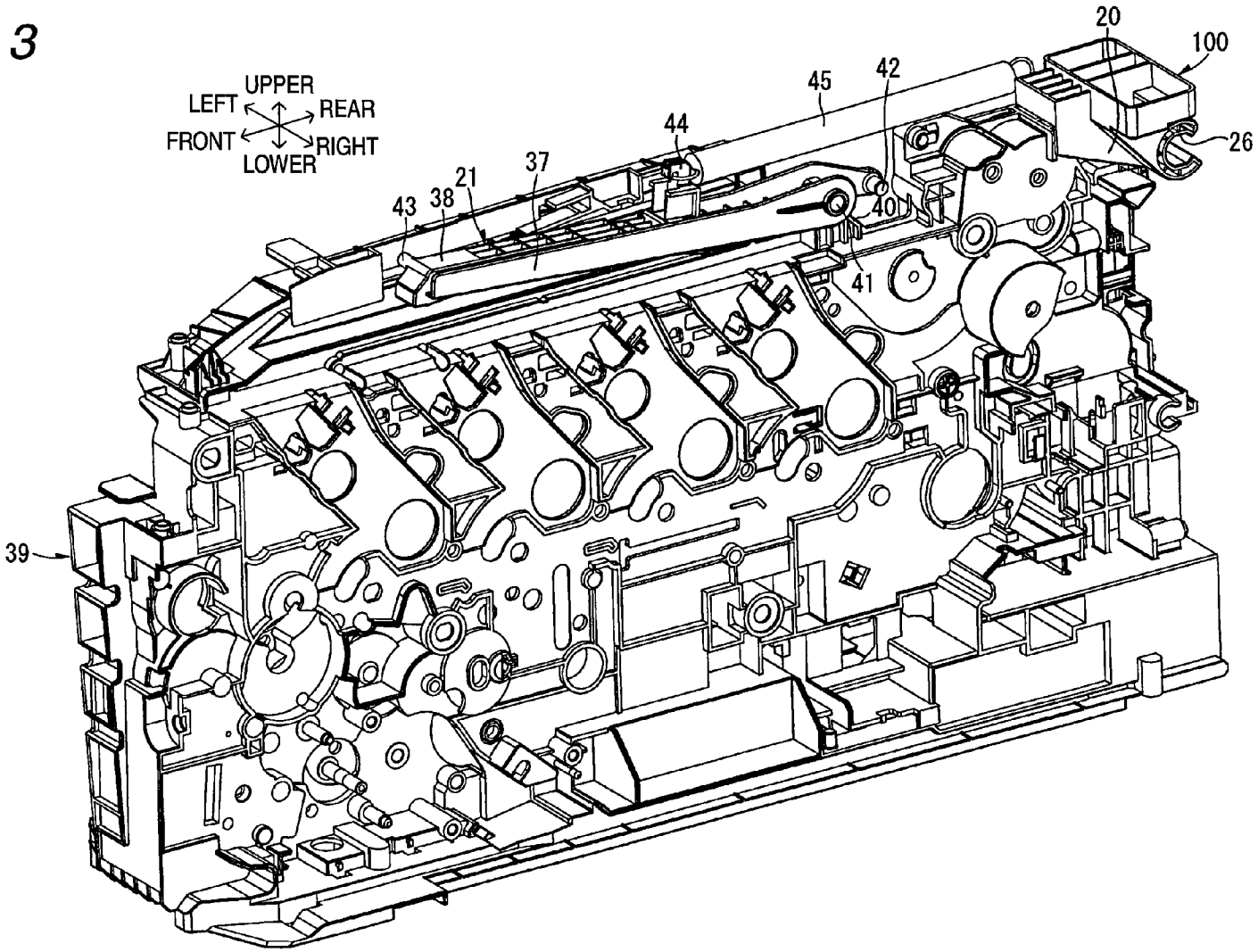
FIG. 3 is a perspective view showing a part of the apparatus body and the support member when the support member is in an adjacent state.
Figure 4:
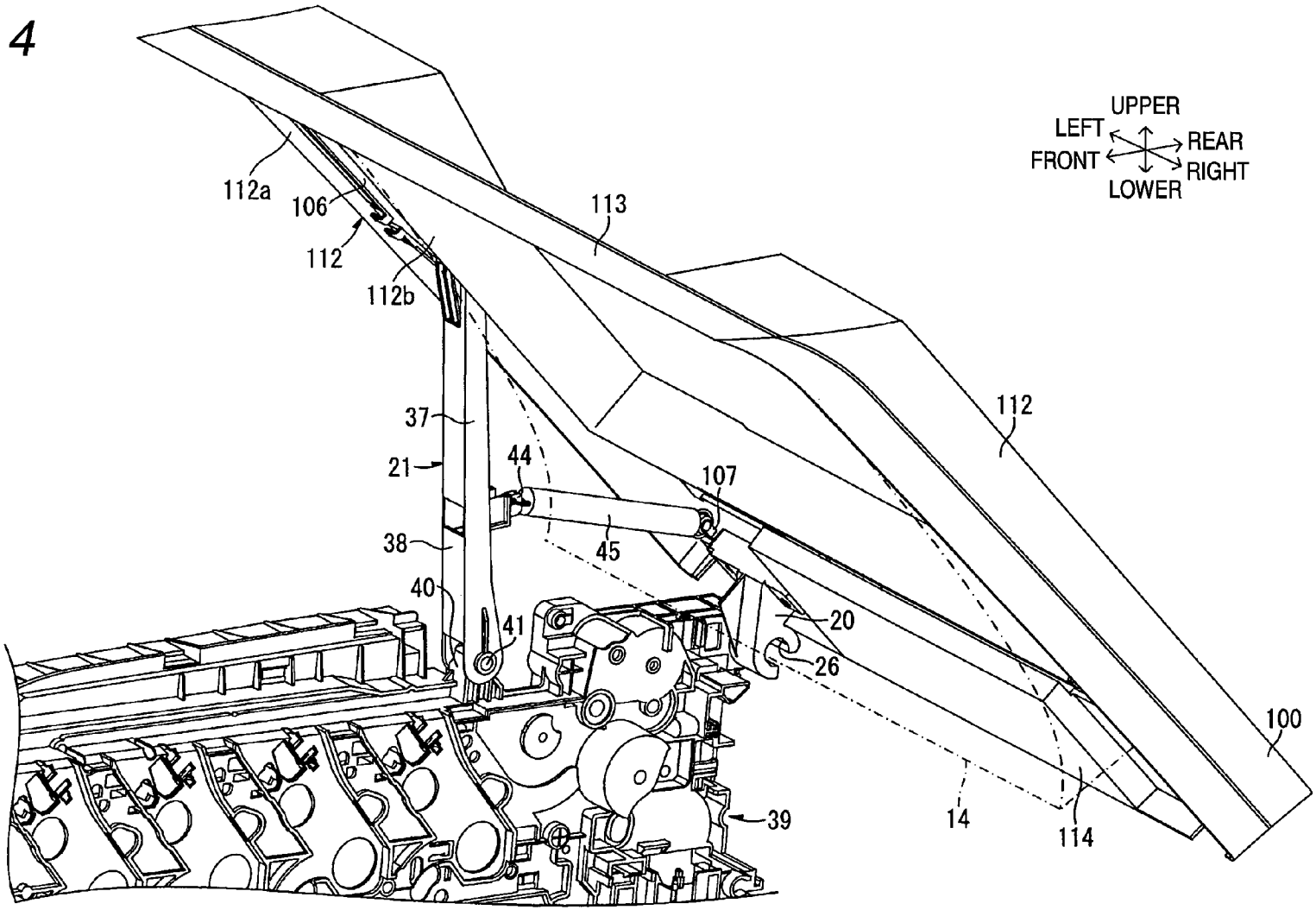
FIG. 4 is a perspective view showing a part of the apparatus body and the support member when the support member is in a distant state.
Figure 5:
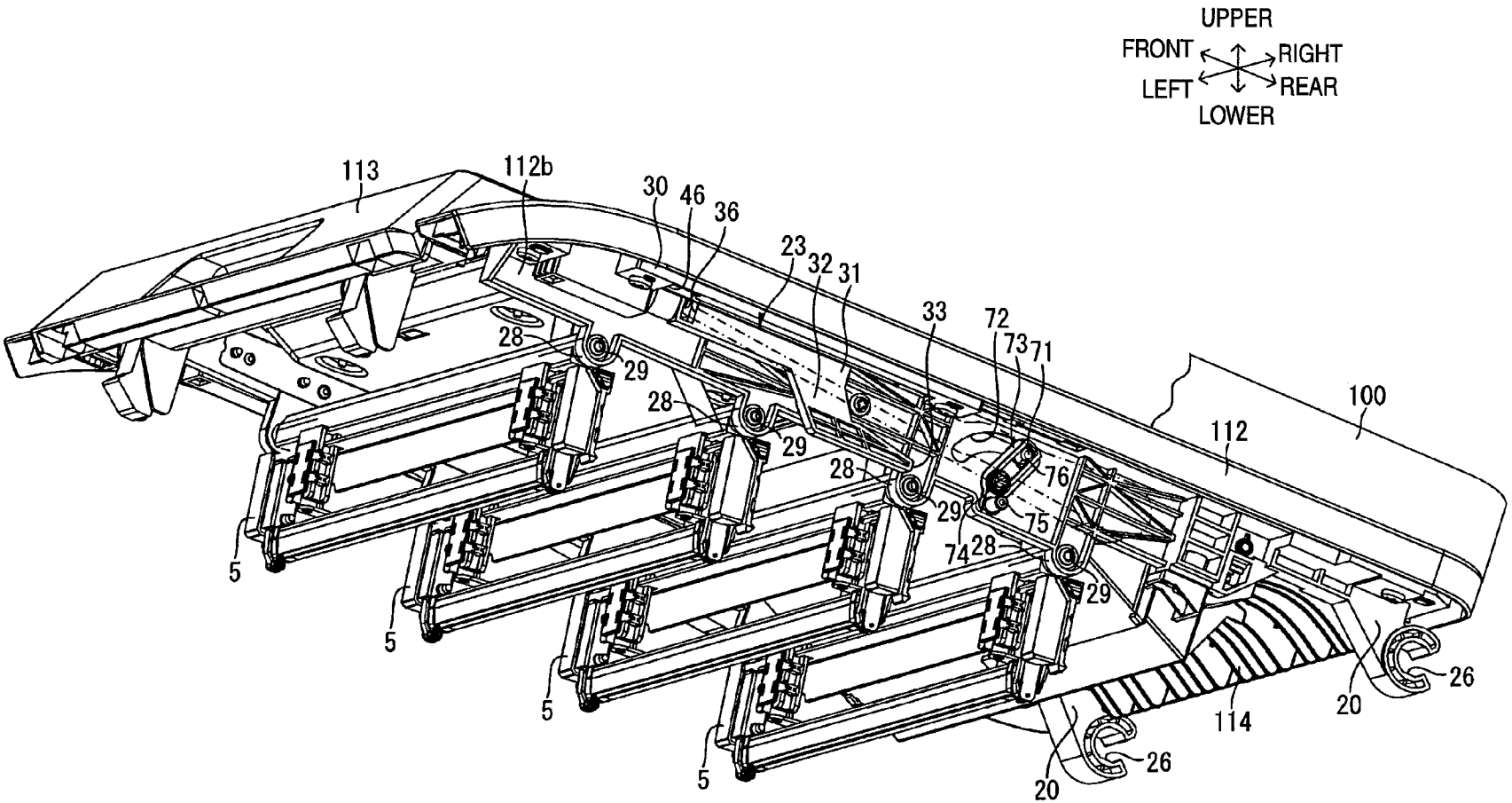
FIG. 5 is a perspective view showing the support member in the adjacent state.
Figure 6:
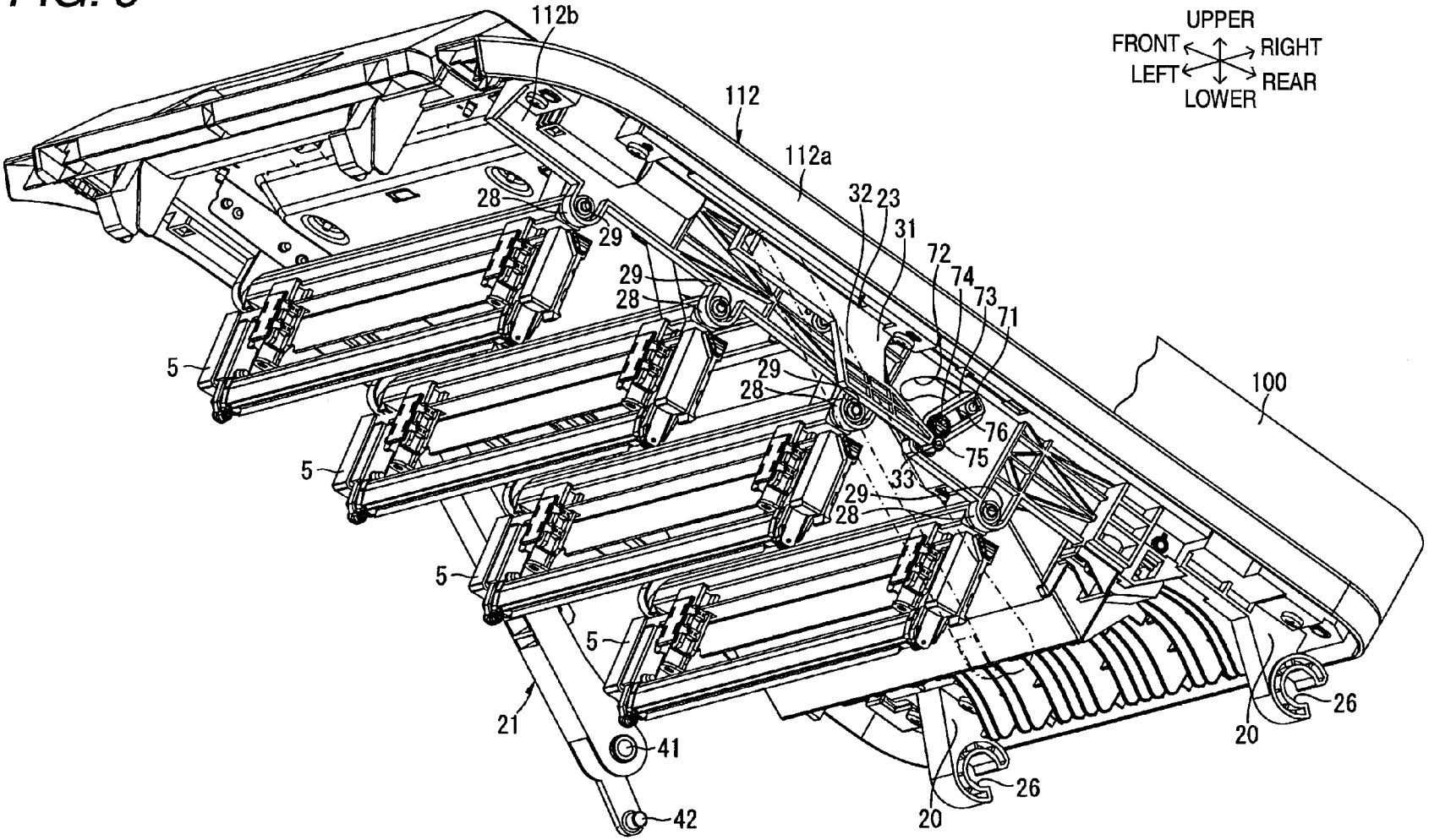
FIG. 6 is a perspective view showing a state where the support member is disposed at a first angle position rotated by a first angle from the adjacent state.
Figure 7:
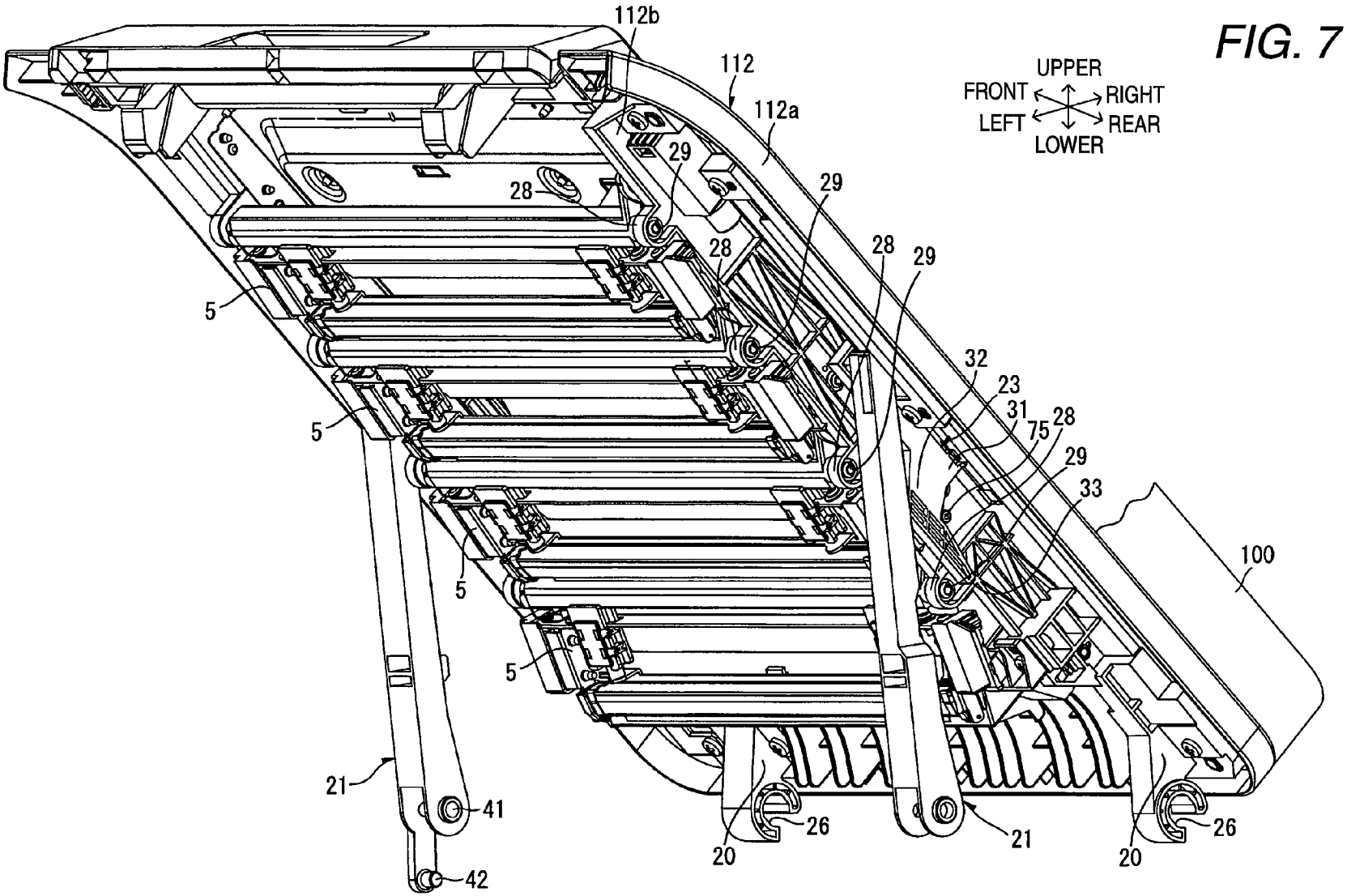
FIG. 7 is a perspective view showing the support member in the distant state.
Figure 11A:
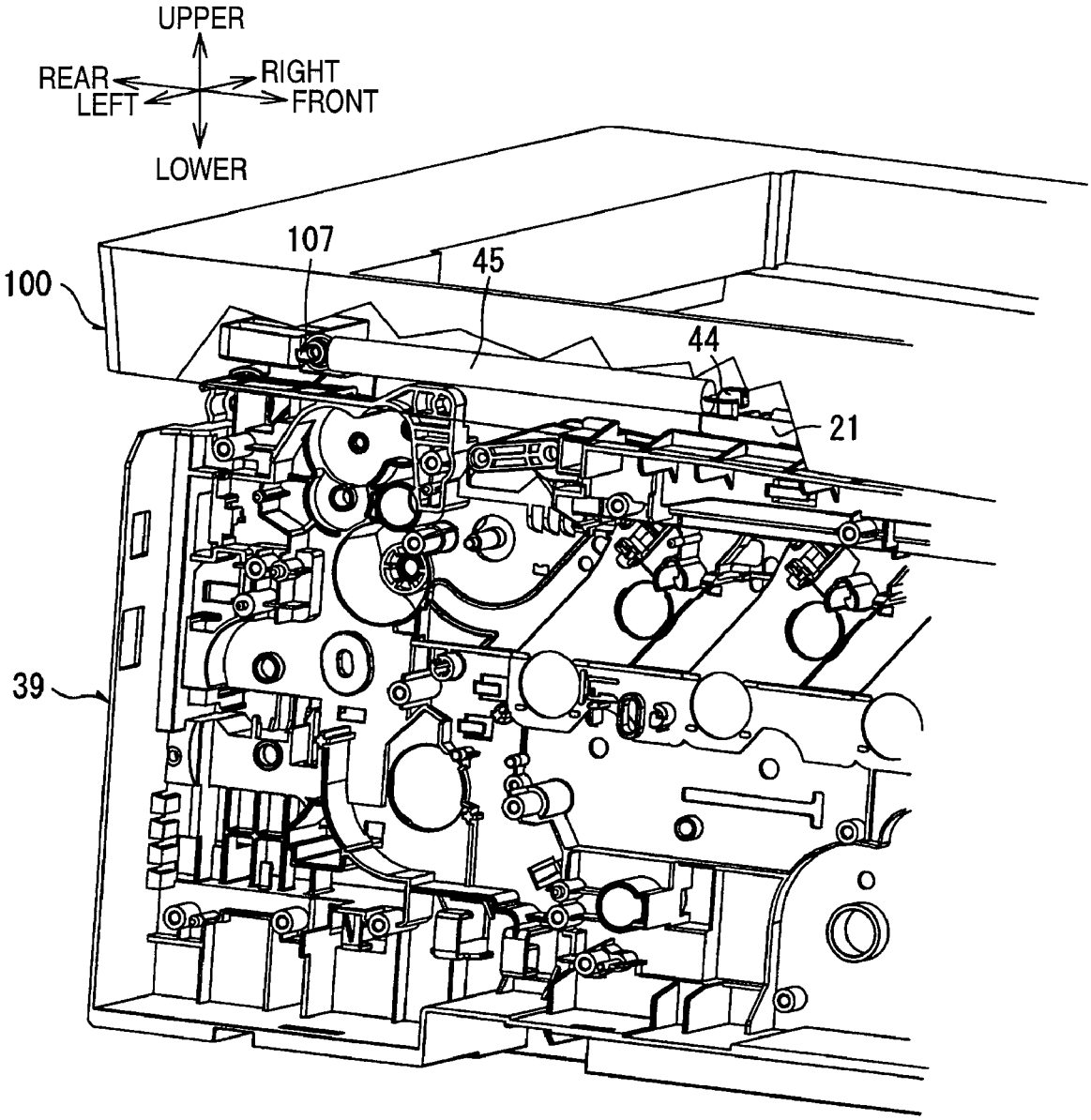
FIG. 11A is a perspective view showing the apparatus body, the support member, and an arm spring when the support member is in the adjacent state.
Figure 11B:
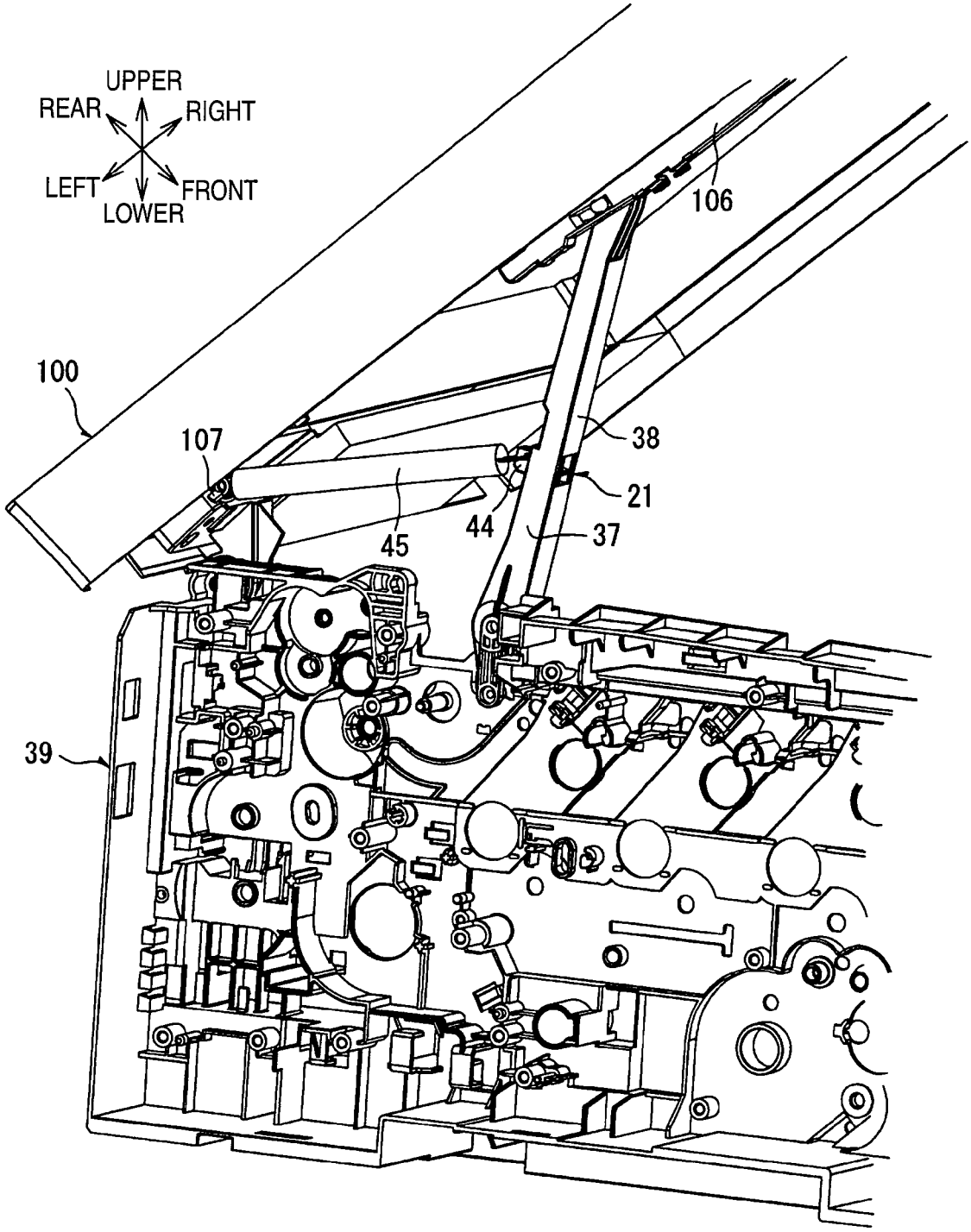
FIG. 11B is a perspective view showing an apparatus body, a support member, and an arm spring when the support member is in the distant state.

FIG. 3 is a perspective view showing a part of the apparatus body 2 and the support member 100 when the support member 100 is in the adjacent state. In addition, FIG. 4 is a perspective view showing a part of the apparatus body 2 and the support member 100 when the support member 100 is in the distant state. FIG. 5 is a perspective view showing the support member 100 in the adjacent state. FIG. 6 is a perspective view showing the support member 100 disposed at a first angle position rotated by a first angle from the adjacent state. FIG. 7 is a perspective view showing the support member 100 in the distant state. FIG. 11A is a perspective view showing the apparatus body 2, the support member 100, and an arm spring 45 when the support member 100 is in the adjacent state. FIG. 11B is a perspective view showing the apparatus body 2, the support member 100, and the arm spring 45 when the support member 100 is in the distant state.

In the following drawings, the flatbed scanner 101 is not shown for the simplicity purpose. In FIGS. 5 to 7, a part of the arm spring 45, which will be described later, and a part of the support member 100 are also omitted. In addition, some components are shown in a broken line.

(1) Support Member

The support member 100 is formed in an approximately rectangular shape in plan view, and includes a pair of leg portions 112 extending in the front and rear direction in the adjacent state shown in FIG. 3, a front connecting portion 113 that connects front ends of the leg portions 112 with each other as shown in FIG. 4, and a rear connecting portion 114 that connects rear ends of the leg portions 112 with each other. An opening formed by the leg portions 112, the front connecting portion 113, and the rear connecting portion 114 is closed by the sheet discharge tray 14 as shown by a broken line in FIG. 4.

(1-1) Leg Portion

Each leg portion 112 is formed to have a U-shaped cross section opened downward and includes: a leg side plate 112*a* located at the outer side in the width direction; a leg side plate 112*b* which faces the leg side plate 112*a* with a gap therebetween in the left and right direction and is located at the inner side in the width direction; and a leg top plate (not shown) which connects upper ends of the leg side plate 112*a* and 112*b* and is connected to a bottom surface of the flatbed scanner 101.

In the leg side plate 112*b* of each leg portion 112 located at the inner side in the width direction, LED support portions 28 for supporting the four LED units 5 are formed at equal distances in the front and rear direction, as shown in FIG. 5. Each LED support portion 28 is formed in a semicircular shape in side view protruding downward from the lower end of the leg side plate 112*b*. An LED support hole 29 is formed to pass through the LED support portion 28 in the width direction.

In the left leg side plate 112*a* of the left leg portion 112, a slide rail 106 that protrudes rightward from the leg side plate 112*a* and extends in the front and rear direction is formed as shown in FIG. 4. A hook-like spring locking portion 107 that protrudes rightward and is bent rearward is formed at the rear end of the left leg side plate 112*a*. The spring locking portion 107 is provided closer to the rotating shaft 15 (refer to FIG. 1) of the apparatus body 2 than the rear end of the slide rail 106. A second end of the arm spring 45, will be described later, is locked to the spring locking portion 107.

In the left leg side plate 112*b* of the right leg portion 112, a movable boss hole 72 formed in an arc from the upper end of the leg side plate 112*b* downward to the front side is formed between the rearmost LED support hole 29 and the LED support hole 29 in front of the rearmost LED support hole 29. A movable boss 71, which will be described later, is inserted in the movable boss hole 72.

An operation member 23 that can slide in the front and rear direction, an arm regulating member 30 for regulating the slide range of an arm 21, and a link member 73 operated by the operation member 23 are provided to the right leg portion 112. The configurations of the operation member 23, the arm regulating portion 30, and the link member 73 will be described in detail later.

(1-2) Rear Connecting Portion

As shown in FIG. 5, in the rear connecting portion 114, two connecting portions 20 are formed at a distance therebetween in the left and right direction (in FIG. 4, the right connecting portion 20 is not shown). The connecting portion 20 is formed in a triangular plate shape in side view protruding from the rear connecting portion 114 downward to the rear side. An annular rotating shaft housing portion 26 is formed at a rear-side lower end of the connecting portion 20. The rotating shaft housing portion 26 has a C shape in side view while a rear-side portion of the rotating shaft housing portion 26 is cut. The rotating shaft 15 (refer to FIG. 1) provided in the apparatus body 2 is rotatably fitted in the rotating shaft housing portion 26. Accordingly, the support member 100 is supported to be rotatable about the rotating shaft 15.

(2) Arm

The apparatus body 2 includes a pair of side walls 39 opposite to each other in the left and right direction. In addition, only the left side wall 39 is shown in FIGS. 3 and 4.

As shown in FIG. 3, the side wall 39 is formed in an approximately rectangular plate shape in side view having a large width in the front and rear direction. A support portion 40 having a triangular shape in side view is formed at the upper end of each side wall 39. A support shaft hole (not shown) is formed to pass through the support portion 40 in the width direction.

A first end of the arm 21 formed in a long and narrow quadrangular prism shape is rotatably supported on the support portion 40.

Each arm 21 includes a pair of arm side plates 37 opposite to each other in the left and right direction and an arm connecting plate 38 that connects the arm side plates 37 with each other. An arm shaft 41 is provided between first ends of the arm side plates 37. The arm shaft 41 is rotatably inserted into the support shaft hole of the support portion 40. Accordingly, the arm 21 is supported to be rotatable about the arm shaft 41 with respect to the apparatus body 2.

At the second end of each arm 21 opposite to the first end, an arm boss 43 protruding leftward is formed in the left arm side plate 37.

The left arm side plate 37 of the left arm 21 is formed to extend toward the first end more than the right side arm side plate 37. A regulation boss 42 protruding rightward is formed at the tip of the left arm side plate 37. The regulation boss 42 comes into contact with a regulation portion (not shown), which is formed on the left side surface of the support portion 40, when the support member 100 is in the distant state (refer to FIG. 4). Accordingly, rotation of the arm 21 beyond such range is regulated.

Furthermore, as shown in FIG. 4, a hook-like spring locking portion 44 that protrudes rearward and is bent upward in a state where the arm 21 is erected with respect to the apparatus body 2 is formed in a middle portion of the arm connecting plate 38 in the left arm 21. A first end of the arm spring 45, which will be described later, is locked to the spring locking portion 44.

The arm boss 43 of the left arm 21 is in contact with the slide rail 106, which is formed in the left leg side plate 112*a* of the left leg portion 112, from above. Accordingly, the second end of the left arm 21 is provided to be slidable rearward with respect to the support member 100 along the slide rail 106.

The arm boss 43 of the right arm 21 is fitted into a groove 36 formed in the operation member 23, which will be described later. The operation member 23 is provided to be slidable in the front and rear direction with respect to the support member 100. Accordingly, the second end of the right arm 21 is provided to be slidable rearward with respect to the support member 100 integrally with the operation member 23.

(3) Arm Spring

The arm spring 45 is a coil spring, and a first end of the arm spring 45 is locked to the spring locking portion 44 of the left arm 21. The second end of the arm spring 45 is locked to the spring locking portion 107 formed in the left leg portion 112. The arm spring 45 is provided to extend in the sliding direction (front and rear direction) of the second end of the arm 21, such that the arm spring 45 expands and contracts with rotating of the arm 21 while the posture thereof changes little as shown in FIGS. 11A and 11B. That is, both the spring locking portion 44 and the spring locking portion 107 are moved as the support member 100 rotates, so that the spring locking portion 44 and the spring locking portion 107 are always disposed at positions not causing a change in expansion and contraction of the arm spring 45.

The arm spring 45 is disposed inside the left leg portion 112 when the support member 100 is in the adjacent state. Specifically, the arm spring 45 is disposed between the leg side plates of the leg portion 112 formed in the U shape when the support member 100 is in the adjacent state. Although not shown, the arm spring 45 is also provided in the right arm 21.

(4) Operation Member

As shown in FIG. 5, the operation member 23 includes a main body 31, which extends in the front and rear direction and has an approximately rectangular plate shape in side view, and an inclined portion 32, which extends from the rear end of the main body 31 downward to the rear side and has a parallelogram shape in side view. A contact portion 33 protruding rearward is formed at the lower end of the inclined portion 32. The contact portion 33 is formed such that the width of the contact portion 33 in the up and down direction decreases toward the rear side, and an upper surface of the contact portion 33 is inclined downward toward the rear side.

A slider (not shown) that extends in the front and rear direction and has a T shape in front view is formed at the upper end of the main body 31. A hole-shaped slide rail (not shown) formed long and narrow in the front and rear direction is formed in the leg top plate of the right leg portion 112. An upper portion of the slider is disposed on the slide rail and a lower portion (portion connected with the main body 31) of the slider is exposed downward from the slide rail, so that the operation member 23 is provided to be slidable in the front and rear direction with respect to the leg portion 112 of the support member 100.

Furthermore, as shown in FIG. 5, the groove 36 in which the arm boss 43 (refer to FIG. 3) of the right arm 21 is received is formed on a right side surface of the front end of the main body 31. When the arm 21 rotates in a state where the arm boss 43 is fitted in the groove 36, the operation member 31 slides in the front and rear direction with the rotating.

(5) Arm Regulating Member

The arm regulating member 30 is provided to a bottom surface of the leg top plate of the right leg portion 112. The arm regulating member 30 is formed in an approximately rectangular long and narrow plate shape in plan view. An arm regulating groove 46 which extends in the front and rear direction and has front and rear ends blocked is formed on a bottom surface of the arm regulating member 30. The second end of the arm 21 is inserted into the arm regulating groove 46 in a state where the arm boss 43 provided at the second end of the right arm 21 is fitted in the groove 36 of the operation member 23. Accordingly, the arm 21 is movable within a range corresponding to the length of the arm regulating groove 46 in the front and rear direction, so that the movement beyond such range is regulated.

(6) Link Member

As shown in FIG. 6, the link member 73 is rotatably supported on a link shaft 74 provided in the left leg side plate 112*b* of the right leg portion 112. The link member 73 is formed to extend in a direction perpendicular to the axial direction of the link shaft 74, and a link boss 75 protruding rightward is formed at one end of the link member 73. A movable boss hole 76 in which the movable boss 71 of the movable member 53, which will be described later, is fitted is formed at the other end of the link member 73.

3. Rotating Mechanism of an LED Unit (1) LED Unit

Figure 8:
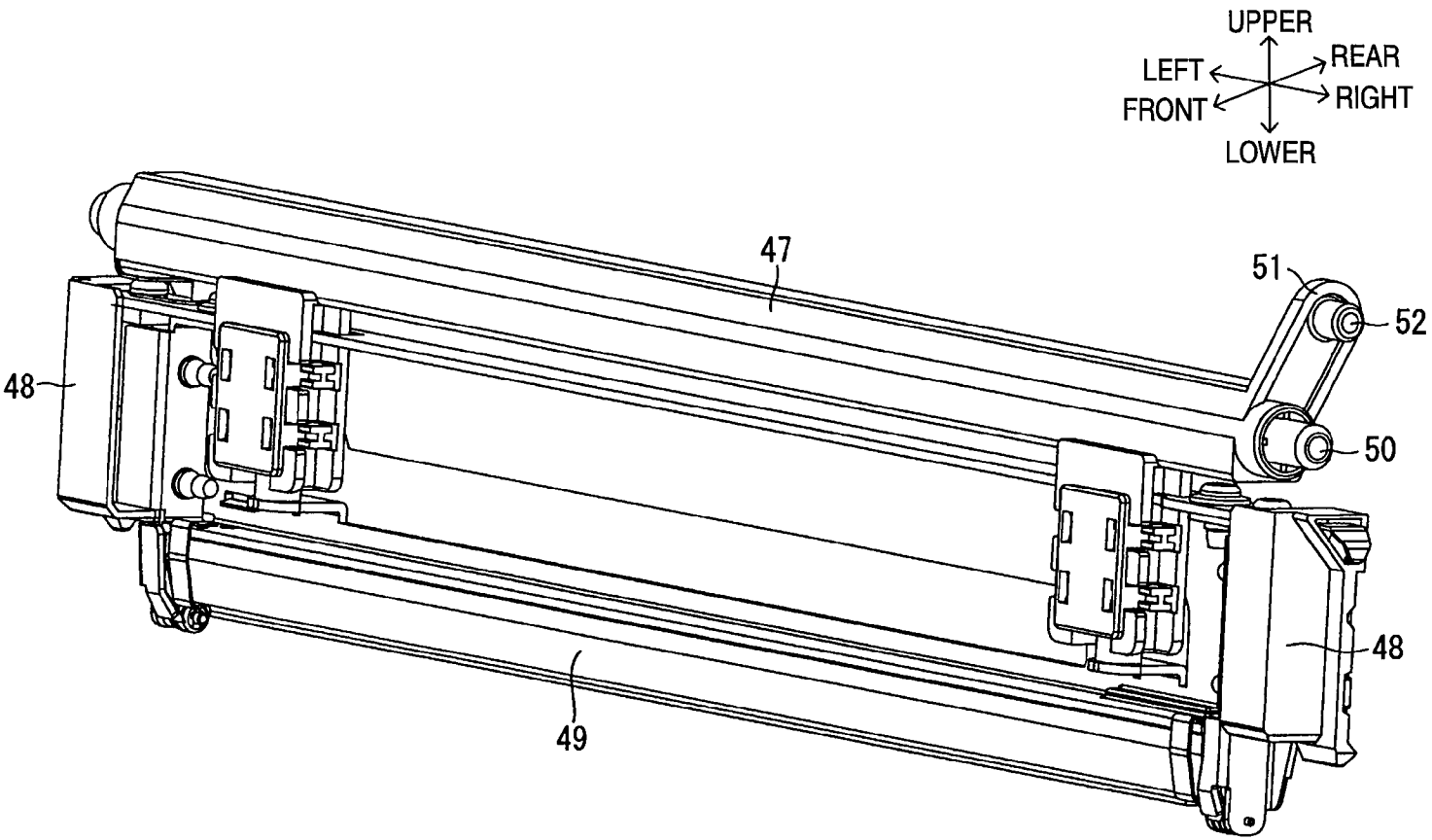
FIG. 8 is a perspective view showing an LED unit.

FIG. 8 is a perspective view showing the LED unit 5. The LED unit 5 includes an LED head 49, two holders 48 for holding the LED head 49, and a connecting member 47 for connecting the holders 48.

The LED head 49 is formed in an approximately inverted triangle shape in side view extending in the width direction. In addition, the LED head 49 is formed by unitizing an LED array (not shown) arrayed linearly along the main-scanning direction (width direction) and a SELFOC lens array (not shown). A bottom surface of the LED head 49 is formed as an exposure surface from which light is emitted.

Each holder 48 is formed in an approximately rectangular shape in side view extending in a direction perpendicular to the longitudinal direction of the LED head 49. In addition, the LED head 49 is held between one ends of the holders 48.

The connecting member 47 is formed in a rod shape extending in the width direction and is disposed between the other ends of the holders 48. The rotating bosses 50 protruding outward in the width direction are formed at both ends of the connecting member 47 in the width direction. As shown in FIG. 5, since the rotating boss 50 is inserted into the LED support hole 29 of each leg side plate 112*b*, the LED unit 5 is supported to be rotatable with respect to the support member 100.

As shown in FIG. 8, an arm portion 51 protruding upward to the rear side is formed on a right end surface of the connecting member 47. A displacement boss 52 protruding outward in the width direction is formed on a protruding end of the arm portion 51. The displacement boss 52 is rotatably supported on the movable member 53, which will be described later.

(2) Movable Member

Figure 9:
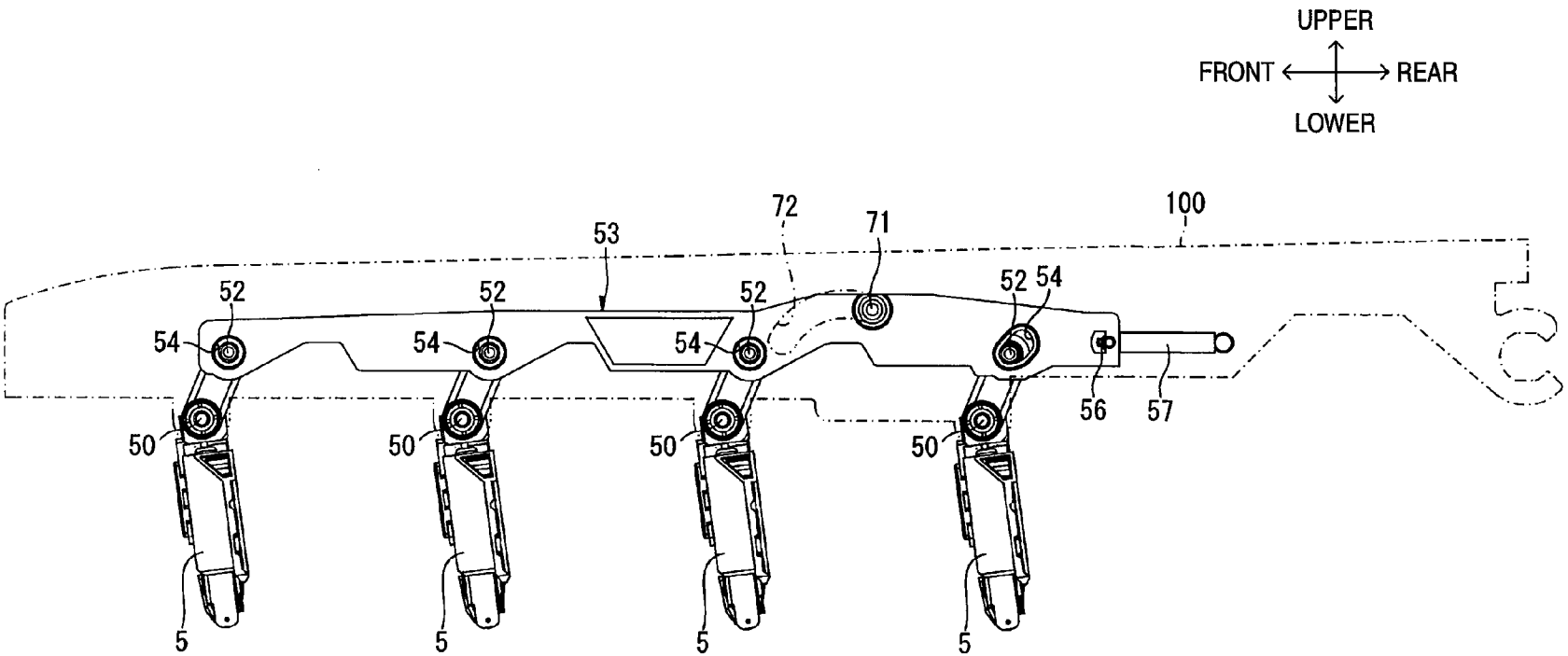
FIG. 9 is a side view showing a movable member and the LED unit when the support member is in the adjacent state.
Figure 10:
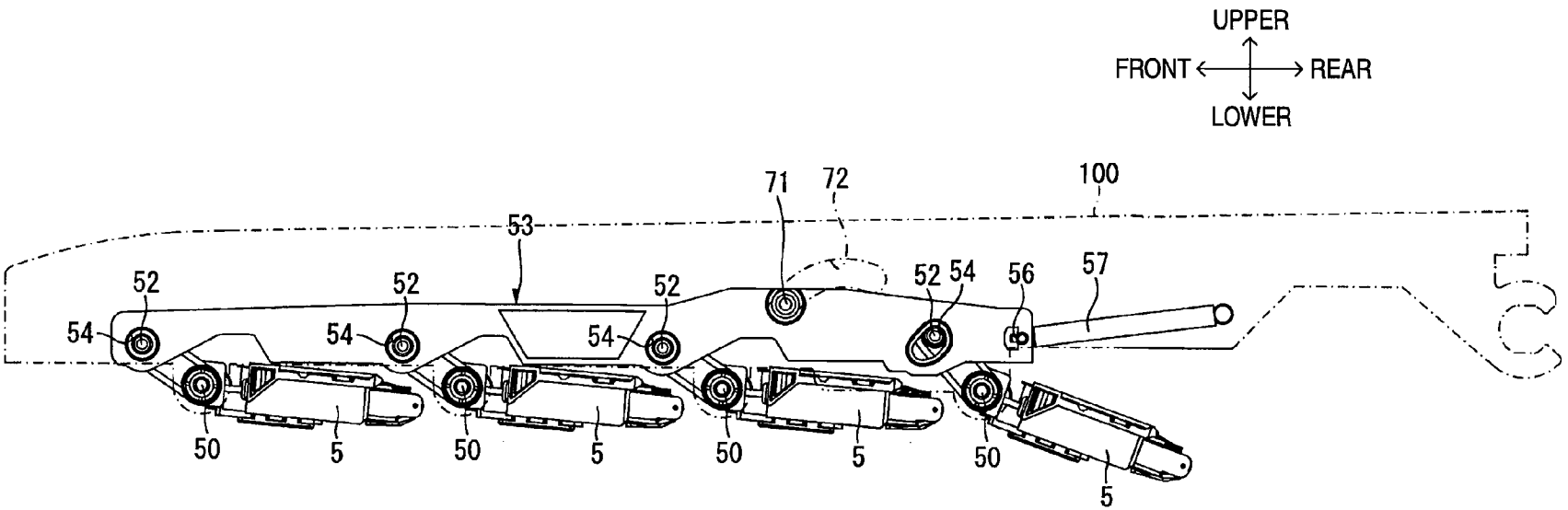
FIG. 10 is a side view showing the movable member and the LED unit when the support member is in the distant state.

FIG. 9 is a side view showing the movable member 53 and the LED unit 5 when the support member 100 is in the adjacent state. FIG. 10 is a side view showing the movable member 53 and the LED unit 5 when the support member 100 is in the distant state.

As shown in FIG. 9, the movable member 53 is formed in an approximately rectangular plate shape in side view extending in the front and rear direction and is disposed on the left side of the left leg side plate 112*b* of the right leg portion 112 (refer to FIG. 5). In the movable member 53, displacement boss holes 54 in which the displacement bosses 52 of the LED unit 5 are inserted are formed at equal distances therebetween in the front and rear direction. A portion of the movable member 53 where each displacement boss hole 54 is formed is formed to have a larger width in the up and down direction than the other portions. The displacement boss hole 54 located at the rearmost side is formed in an elliptical shape extending in the up and down direction compared with the other three displacement boss holes 54.

A hook-like spring locking portion 56 that protrudes leftward and is bent frontward is formed at the rear end of the movable member 53. One end of a spring 57 for urging the movable member 53 rearward is locked to the spring locking portion 56. A spring locking portion (not shown) to which the other end of the spring 57 is locked is formed in the support member 100, such that the movable member 53 is urged rearward.

The movable boss 71 protruding rightward is formed between the rearmost displacement boss hole 54 of the movable member 53 and the displacement boss hole 54 in front of the rearmost displacement boss hole 54. The movable boss 71 passes through the movable boss hole 72 formed in the leg side plate 112*b* to protrude rightward and is held in the movable boss hole 76 of the link member 73.

4. Opening and Closing Operations of a Support Member

Hereinafter, an operation of the support member 100 will be described mainly referring to FIGS. 5 to 7, 9, and 10.

As shown in FIGS. 5 and 9, the left and right arms 21 are positioned approximately horizontally when the support member 100 is in the adjacent state. In this state, the arm boss 43 of the left arm 21 is disposed on the front end of the slide rail 106. The arm boss 43 of the right arm 21 is fitted in the groove 36 of the operation member 23. The operation member 23 is disposed at the front end in a slidable range. The tip of each LED unit 5 becomes relatively distant from the support member 100, such that each LED unit 5 takes a first posture at which the LED unit 5 can expose a surface of the photosensitive drum 6 (refer to FIG. 1). As shown in FIG. 9, the movable member 53 is urged rearward by the spring 57 and the movable boss 71 is disposed at the rear end of the movable boss hole 72.

When locking of the support member 100 to the apparatus body 2 is released in this state, the urging force of the arm spring 45 (refer to FIG. 3) is applied such that the second end of the left arm 21 slides rearward and the left arm 21 rotates in a direction erected with respect to the apparatus body 2. Then, the support member 100 rotates toward the distant state. As the support member 100 rotates, the right arm 21 rotates in a direction erected with respect to the apparatus body 2. Thereby, the second end of the right arm 21 slides rearward together with the operation member 23. When the support member 100 is disposed at the first angle position at which the support member 100 is rotated by the first angle (for example, 40°) from the adjacent state, the contact portion 33 of the operation member 23 comes in contact with the link boss 75 of the link member 73 from the front side, as shown in FIG. 6. At this time, the left and right arms 21 rotate with approximately the same posture.

In this state, when the second ends of the left and right arms 21 further slide rearward and the left and right arms 21 further rotate in the direction erected with respect to the apparatus body 2, the support member 100 further rotates. At this time, the operation member 23 further moves rearward with the movement of the second end of the right arm 21. Then, the link boss 75 rides on the contact portion 33 to move on the inclined surface of the contact portion 33. As a result, the link member 73 rotates about the link shaft 74 and moves to the front end of the movable boss hole 72 integrally with the movable boss 71. As shown in FIG. 10, the movable member 53 moves downward to the front side with the movement of the movable boss 71. As a result, each LED unit 5 rotates about the LED support hole 29.

When the support member 100 is disposed in a distant state (for example, a state where the support member 100 is rotated by 45° from the adjacent state), rearward movements of the second ends of the left and right arms 21 beyond the range are regulated as shown in FIG. 7. At this time, the left and right arms 21 take a posture rotated within an angle range of 90° or less from the posture when the support member 100 is in the adjacent state. In addition, each LED unit 5 takes a second posture in which the tip end faces toward the rotating shaft 15 (refer to FIG. 1).

On the other hand, when the support member 100 rotates toward the adjacent state from the above state, the operation member 23 (refer to FIG. 7) moves frontward and the link boss 75 is separated from the contact portion 33. Then, by the urging force of the spring 57, the movable member 53 moves upward to the rear side and the movable boss 71 is disposed at the rear end side of the movable boss hole 72. As a result, each LED unit 5 rotates about the LED support hole 29 and takes the first posture at which the LED unit 5 can expose the surface of the photosensitive drum (refer to FIG. 1).

5. Operations and Effects

As described above, the first end of the support member 100 is supported on the apparatus body 2 to be rotatable about the rotating shaft 15. The support member 100 rotates between the adjacent state in which the second end becomes relatively adjacent to the apparatus body 2, and the distant state in which the second end becomes relatively distant from the apparatus body 2. The first end of the arm 21 is rotatably supported on the apparatus body 2. The second end of the arm 21 is connected to the support member 100 to be slidable in a direction perpendicular to the rotating shaft 15. The first end of the arm spring 45 is connected to the arm 21. The second end of the arm spring 45 is connected to the support member 100 at position closer to the rotating shaft 15 than a portion of the support member 100 to which the arm 21 is connected. To the second end of the arm 21, an urging force in a direction of drawing the arm 21 to a side of the rotating shaft 15 is applied by the arm spring 45. Accordingly, even if the first end of the arm 21 is disposed closer to the rotating shaft 15 than the second end, and both a rotating angle range of the arm 21 and a rotating angle range of the support member 100 are less than 90°, the support member 100 can be held in the distant state. As a result, when the maintenance of the apparatus body 2 is performed, the workability can be improved because the operator does not need to support the support member 100 in a distant state by hand. Furthermore, since the second end of the arm spring 45 is connected to the support member 100, the arm spring 45 can be positioned in a direction parallel to the urging direction compared with a configuration where the second end of the arm spring 45 is provided to the apparatus body 2. Accordingly, the urging force can be efficiently applied to the arm 21.

The arm spring 45 expands and contracts while changes the posture little as the arm 21 rotates. Accordingly, since a change in the force applied to the locking portions 44 and 107 is small, damage and deformation of the arm 21 (locking portions 44 and 107) can be prevented.

In addition, the LED unit 5 is rotatably supported on the support member 100. The LED unit 5 is rotated by sliding of the second end of the arm 21. The second end of the arm 21 rotates with rotating of the support member 100. Therefore, by rotating the support member 100, the second end of the arm 21 slides, so that the LED unit 5 can rotate with the rotating of the support member 100.

Furthermore, the photosensitive drum 6 is provided in the apparatus body 2. When the support member 100 is in the adjacent state and the second end of the arm 21 is at a position becoming relatively distant from the rotating shaft 15, the LED unit 5 takes the first posture becoming relatively distant from the support member 100 such that the tip of the LED unit 5 faces the photosensitive drum 6. Accordingly, the LED unit 5 can expose the surface of the photosensitive drum 6 when the LED unit 5 is in the first posture.

Furthermore, when the support member 100 is in the distant state and the second end of the arm 21 is at a position becoming relatively adjacent to the rotating shaft 15, the LED unit 5 takes the second posture becoming relatively adjacent to the support member 100. Accordingly, when the support member 100 is in the distant state, it can be prevented that the tip end of the LED unit 5 is exposed to an open side opposite to the rotating shaft 15. As a result, it is possible to prevent contaminants from adhering to an exposure surface of the LED head 49, which is the tip of the LED unit 5, or prevent the exposure surface of the LED head 49 from being damaged.

Furthermore, when the support member 100 rotates between the adjacent state and the distant state, the arm 21 rotates in an angle range less than 90° with the rotating of the support member 100. This can regulate the rotating angle range of the support member 100.

In addition, the support member 100 rotates in an angle range less than 90°. Accordingly, even if the support member 100 is disposed above the apparatus body 2, it can be prevented that the support member 100 collides with a wall disposed at a side of the rotating shaft 15 of the printer 1 or the printer 1 becomes unbalanced to fall when the support member 100 is in the distant state.

Furthermore, the arm spring 45 is provided to expand and contract in a direction approximately parallel to the sliding direction of the second end of the arm 21 as the arm 21 rotates. Accordingly, the urging force can be more efficiently applied to the arm 21.

In addition, the flatbed scanner 101 for reading an image formed on a document is provided in the printer 1. The flatbed scanner 101 is supported by the support member 100. Accordingly, the operator does not need to support the support member 100 in the distant state by hand when performing the maintenance of the apparatus body 2. As a result, since a large burden is not applied to the operator even if a relatively heavy flatbed scanner 101 is supported on the support member 100, there is no possibility that the workability will deteriorate.

In addition, the leg portion 112 for receiving the arm spring 45 therein is formed in the support member 100. Accordingly, it is not necessary to prepare a space for receiving the arm spring 45 in the apparatus body 2. As a result, the apparatus body 2 can be made small.

What is claimed is:

1. An image forming apparatus comprising:

an apparatus body;

a first rotating body comprising a first end, and a second end opposite to the first end, the first end being supported on the apparatus body rotatably about an axis so that the first rotating body is rotatable between an adjacent state in which the second end is close to the apparatus body, and a distant state in which the second end is more distant from the apparatus body than the adjacent state;

an arm comprising a first end rotatably supported on the apparatus body, and a second end opposite to the first end, the second end being connected to the first rotating body to be slidable in a direction perpendicular to the axis; and an urging member comprising a first end connected to the arm, and a second end opposite to the first end, the second end being connected to the first rotating body at a position between the axis and a connecting portion to which the arm is connected, the urging member applying an urging force to the arm in a direction of drawing the second end of the arm toward the axis.

2. The image forming apparatus according to claim 1, further comprising a second rotating body rotatably supported on the first rotating body and rotates with sliding of the second end of the arm.

3. The image forming apparatus according to claim 2, wherein when the first rotating body is in the adjacent state, the second end of the arm becomes a distant position distant from the axis and the second rotating body takes a first posture in which the second rotating body is distant from the first rotating body, and wherein when the first rotating body is in the distant state, the second end of the arm becomes an adjacent position closer to the axis than the distant position, and the second rotating body takes a second posture in which the second rotating body is closer to the first rotating body than the first posture.

4. The image forming apparatus according to claim 3, further comprising a photoconductor housed in the apparatus body, wherein the second rotating body includes an exposure device, and wherein when the first rotating body is in the adjacent state, the second rotating body takes the first posture so that the exposure device faces the photoconductor to expose a surface of the photoconductor.

5. The image forming apparatus according to claim 3, wherein when the first rotating body is in the distant state and the second rotating body takes the second posture, a tip end of the second rotating body faces toward the axis.

6. The image forming apparatus according to claim 1, wherein the arm is provided to rotate within an angle range less than 90° with rotating of the first rotating body between the adjacent state and the distant state.

7. The image forming apparatus according to claim 6, wherein the first rotating body rotates within an angle range less than 90°.

8. The image forming apparatus according to claim 7, wherein the arm comprises a regulation protrusion, and wherein a rotatable angle range of the first rotating body is regulated to be less than 90° by the regulation protrusion of the arm contacting a regulation portion of the apparatus body.

9. The image forming apparatus according to claim 1, wherein the urging member includes a spring which generates an urging force by expansion and is provided to expand and contract in a direction approximately parallel to a sliding direction of the second end of the arm with rotating of the arm.

10. The image forming apparatus according to claim 1, further comprising a flatbed scanner which includes a flat set surface, on which a document is placed, and reads an image on the document placed on the flat set surface, wherein the first rotating body corresponds to a support leg which supports the flatbed scanner.

11. The image forming apparatus according to claim 10, wherein the first rotating body comprises a housing portion which houses the urging member therein when the first rotating body is in the adjacent state.

* * * * *